US008648243B2

(12) United States Patent
Susami

(10) Patent No.: US 8,648,243 B2
(45) Date of Patent: Feb. 11, 2014

(54) MUSICAL TONE GENERATION CONTROL DEVICE AND METHOD

(71) Applicant: Roland Corporation, Shizuoka-ken (JP)

(72) Inventor: Ryo Susami, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 13/738,849

(22) Filed: Jan. 10, 2013

(65) Prior Publication Data

US 2013/0180386 A1 Jul. 18, 2013

(30) Foreign Application Priority Data

Jan. 13, 2012 (JP) ..... 2012-004865

(51) Int. Cl.
*G10H 7/00* (2006.01)

(52) U.S. Cl.
USPC ..... 84/621; 84/653

(58) Field of Classification Search
USPC ..... 84/621, 653
See application file for complete search history.

(56) References Cited

U.S. PATENT DOCUMENTS

| | | | | |
|---|---|---|---|---|
| 4,924,741 | A * | 5/1990 | Vollenweider | 84/730 |
| 4,932,303 | A * | 6/1990 | Kimpara | 84/621 |
| 5,552,562 | A * | 9/1996 | Hertz et al. | 84/726 |
| 5,841,052 | A * | 11/1998 | Stanton | 84/600 |
| 8,317,614 | B2 * | 11/2012 | McCauley et al. | 463/37 |
| 8,507,782 | B2 * | 8/2013 | Takehisa et al. | 84/626 |
| 2010/0319519 | A1 * | 12/2010 | Takehisa et al. | 84/723 |
| 2011/0303075 | A1 * | 12/2011 | McMillen et al. | 84/645 |
| 2012/0060669 | A1 * | 3/2012 | Ryan et al. | 84/723 |
| 2012/0060670 | A1 * | 3/2012 | Truchsess | 84/724 |
| 2012/0097009 | A1 * | 4/2012 | Eventoff et al. | 84/413 |
| 2012/0304848 | A1 * | 12/2012 | Haddad | 84/724 |
| 2013/0125729 | A1 * | 5/2013 | Eventoff et al. | 84/413 |
| 2013/0152768 | A1 * | 6/2013 | Rapp | 84/634 |
| 2013/0180386 | A1 * | 7/2013 | Susami | 84/621 |

FOREIGN PATENT DOCUMENTS

| | | |
|---|---|---|
| JP | H07-043589 | 5/1995 |
| JP | H07-069687 | 7/1995 |
| JP | 2000-099005 | 4/2000 |
| JP | 2009-258200 | 11/2009 |

* cited by examiner

*Primary Examiner* — David S. Warren
(74) *Attorney, Agent, or Firm* — Foley & Lardner LLP

(57) ABSTRACT

A tone generation control device sets a setting value for crosstalk cancellation. When vibration generated in a target striking surface is detected, a value indicative of the degree of crosstalk that the target received from comparison striking surfaces is calculated. The calculated value is displayed regardless of whether a tone generation instruction has been output. Meanwhile, setting values used for crosstalk cancellation for the respective striking surfaces are also displayed. Therefore, the user can observe and understand as to whether the vibration generated at the target is vibration caused by crosstalk received from the comparison striking surface, such that setting values to be used for crosstalk cancellation can be suitably set.

20 Claims, 10 Drawing Sheets

FIG. 3

(a)

13a

| 13a1 JACK NUMBER | 13a2 TERMINAL NAME | 13a3 CONNECTION FLAG | 13a4 STRIKING FLAG | 13a5 CROSSTALK CANCELLATION FLAG | 13a6 CROSSTALK FLAG | 13a7 AMOUNT OF CROSSTALK |
|---|---|---|---|---|---|---|
| 1 | K | 0 | 0 | 0 | 0 | 0 |
| 2 | S | 0 | 0 | 0 | 0 | 0 |
| 3 | T1 | 1 | 0 | 0 | 1 | 18 |
| 4 | T2 | 1 | 1 | 0 | 0 | 0 |
| 5 | T3 | 1 | 0 | 1 | 0 | 15 |
| 6 | T4 | 1 | 0 | 0 | 1 | 22 |
| 7 | HH | 0 | 0 | 0 | 0 | 0 |
| 8 | C1 | 0 | 0 | 0 | 0 | 0 |
| 9 | C2 | 0 | 0 | 0 | 0 | 0 |
| 10 | RD | 0 | 0 | 0 | 0 | 0 |
| 11 | EG | 0 | 0 | 0 | 0 | 0 |

(b)

14a

| 14a1 JACK NUMBER | 14a2 TERMINAL NAME | 14a3 CROSSTALK CANCELLATION SET VALUE |
|---|---|---|
| 1 | K | 10 |
| 2 | S | 10 |
| 3 | T1 | 10 |
| 4 | T2 | 30 |
| 5 | T3 | 30 |
| 6 | T4 | 20 |
| 7 | HH | 10 |
| 8 | C1 | 40 |
| 9 | C2 | 5 |
| 10 | RD | 40 |
| 11 | EG | 30 |

(a)

(b)

MUSICAL TONE GENERATION CONTROL DEVICE AND METHOD

CROSS-REFERENCE TO RELATED PATENT APPLICATIONS

Japan Priority Application No. 2012-004865, filed on Jan. 13, 2012, including the specification, drawings, claims and abstract, is incorporated herein by reference in its entirety.

FIELD OF THE INVENTION

Embodiments of the present invention relate to tone generation control devices and methods and, in particular embodiments, to tone generation control devices that can set setting values for processing to prevent erroneous tone generation due to crosstalk caused from strikes on other striking surfaces.

BACKGROUND

Some electronic percussion instruments have been configured with a plurality of striking surfaces disposed on the same stand (e.g., as a drum set) and as an instrument with a plurality of striking surfaces installed in the same housing case. In these electronic percussion instruments, when a certain striking surface is struck by a user, the vibration energy generated by the strike is transmitted through the stand or the case. When one of the striking surfaces is struck, the strike may cause crosstalk with other striking surfaces that have not been struck, and the striking surfaces that have not been struck may erroneously generate a tone. Therefore, in such electronic percussion instruments, processing has been performed to prevent error-tone generation due to crosstalk from other striking surfaces (where, this processing is referred to herein as "crosstalk cancellation").

For example, according to the technology described in Japanese Patent Publication HEI 07-043589, the difference or the ratio between a detection value of vibration generated at a certain striking surface (a target striking surface) and a detection value of vibration generated at another striking surface (a comparison striking surface) is calculated. Then, crosstalk cancellation is performed based on the comparison of the calculated difference or the ratio with a predetermined setting value. Whether or not crosstalk cancellation for vibration of a target striking surface is to be performed can be determined based on a setting value for crosstalk cancellation, as described in Japanese Patent Publication HEI 07-043589. A more optimal crosstalk cancellation can be performed by suitably changing the setting value.

FIG. 10 represents an example of a conventional screen for changing setting values for crosstalk cancellation. As shown in FIG. 10, reference numbers 200*a* representing respective striking surfaces and reference numbers 200*b* representing current setting values are displayed in a side by side arrangement on the screen. To change a setting value, the user moves a cursor 201 to the position of a setting value 200*b* that is desired to be changed and, then, increases or decreases that setting value.

However, the screen in FIG. 10 merely displays the numbers 200*a* and the setting values 200*b*. Therefore, on that screen, the user is not able to identify which striking surface, from the plural striking surfaces, has generated a tone as a result of crosstalk received from another striking surface. Therefore, users typically tried to identify by ear, the striking surface that generated a tone due to crosstalk from another striking surface.

Moreover, for striking surfaces that have not been struck and have not generated a tone, the screen in FIG. 10 does not show whether the tone was not generated because trigger signals were not generated or, instead, because crosstalk cancellation was executed although trigger signals had been generated. Therefore, it is possible for crosstalk cancellation to be executed excessively from the setting values 200*b* displayed on the screen in FIG. 10. When crosstalk cancellation is excessively executed and multiple striking surfaces are simultaneously struck, it is possible that strikes other than the first detected strike may be subject to crosstalk cancellation and tones corresponding to the strikes may not be generated.

SUMMARY OF THE DISCLOSURE

In contrast, embodiments of the present invention relate to a tone generation control device that can control so that a user can suitably set setting values for crosstalk cancellation.

In a tone generation control device according to an embodiment of the present invention, when vibration generated in one striking surface (a target striking surface) among plural striking surfaces is detected by a detection device, a value indicative of the degree of crosstalk that the target striking surface received from comparison striking surfaces (striking surfaces among the plural striking surfaces other than the target striking surface) is calculated by a value calculation device. The calculated value indicative of the degree of crosstalk is displayed on a display device by a display control device, regardless of whether or not a tone generation instruction has been output by a tone generation instruction control device. Meanwhile, setting values for the respective striking surfaces, which are stored in a setting value storage device, are also displayed on the display device by the display control device. The setting values are used to determine whether or not the vibration is caused by crosstalk for which tone generation instructions should not be output.

Therefore, from the display of the value indicative of the degree of crosstalk, the user can determine whether or not the vibration generated at the target striking surface is vibration caused by crosstalk received from the comparison striking surface. Moreover, setting values to be used to determine whether or not a vibration is caused by crosstalk for which a tone generation instruction should not be output are displayed together with the display of the value indicative of the degree of crosstalk. Therefore, based on the display of the value indicative of the degree of crosstalk, the user can determine whether or not the setting value is a proper value, and whether or not it should be changed.

Also, because the display of the value indicative of the degree of crosstalk is made regardless of whether a tone generation instruction has been output by the tone generation instruction control device, the user can determine whether the present setting value is proper, even when the tone generation instruction has not been output (that is, when crosstalk cancellation has been executed). Therefore, with a tone generation control device according to the above described embodiment, setting values for crosstalk cancellation can be reliably set.

A further example of a tone generation control device according to the above-described embodiment includes a mutually distinguishable display provided on the display device by the display control device, showing whether or not the tone generation instruction was output by the tone generation instruction control device. Therefore, the user can clearly distinguish and understand as to whether the display of the value indicative of the degree of crosstalk is a display made when a tone generation instruction has been output, or a display made when a tone generation instruction has not been output (that is, when crosstalk cancellation has been executed).

In a further example of a tone generation device according to any of the embodiments described above, each time a first operation is input, among the striking surfaces for which the display of the value indicative of the degree of crosstalk is shown on the display part, those striking surfaces for which the tone generation instruction is output by the tone generation instruction control device are switched and selected, one by one, as a selected striking surface by the striking surface selection device. When a second operation is input, the setting value stored for the selected striking surface in the setting value storage device is updated by the setting value change device, based on the value calculated by the value calculation device for the selected striking surface (that is, the value representative of the degree of crosstalk). Therefore, the setting value set for a selected striking surface for which a tone generation instruction has been output without executing crosstalk cancellation can be changed based on the value indicative of the degree of crosstalk calculated from actual vibrations. Accordingly, the setting value can be readily set to a proper value such that a tone generation instruction is not output when crosstalk is generated (that is, crosstalk cancellation is to be executed).

In a further example of a tone generation device according to various embodiments described above, when the value indicative of the degree of crosstalk is calculated by the value calculation device, the setting value stored for the striking surface in the setting value storage device is updated by the setting value change device based on the calculated value indicative of the degree of crosstalk. Therefore the setting value for the selected striking surface can be automatically changed based on the value indicative of the degree of crosstalk calculated from actual vibrations. Accordingly, the setting value can be readily set to a proper value such that a tone generation instruction is not output when crosstalk is generated.

In a further example of a tone generation device according to any of the embodiments described above, the calculation of the value indicative of the degree of crosstalk by the value calculation device is performed based on the level of vibration generated at the target striking surface and the level of vibration of the comparison striking surface which changes with time. Therefore, because the value indicative of the degree of crosstalk can be calculated as a value that does not depend on the positional relation between the target striking surface and the comparison striking surface, appropriate crosstalk cancellation is enabled, while improving the degree of freedom and flexibility in arranging the plural striking surfaces relative to each other.

In a further example of a tone generation device according to any of the embodiments described above, the determination by the determination device (whether or not vibration is caused by crosstalk for which a tone generation instruction should not be output) is made based on the level of vibration generated in the target striking surface, the level of vibration of the comparison striking surface which changes with time, and the setting value stored in the setting value storage device. Therefore, because the determination is made without regard to the positional relation between the target striking surface and the comparison striking surface, appropriate crosstalk cancellation is enabled, while improving the degree of freedom and flexibility in arranging the plural striking surfaces relative to each other.

BRIEF DESCRIPTION OF THE DRAWINGS

FIG. 3(*a*) is a schematic diagram representing memory contents stored in a display information area.

FIG. 3(*b*) is a schematic diagram representing memory contents stored in a setting value area.

FIG. 5(*b*) is a graph for explaining a method of calculating the amount of crosstalk, using the envelope for crosstalk amount calculation.

FIG. 5(*c*) is a graph for explaining a method of crosstalk cancellation determinations, using the envelope for crosstalk cancellation.

FIG. 7(*b*) is a flow chart of crosstalk cancellation level calculation processing.

DETAILED DESCRIPTION

Figure 1:
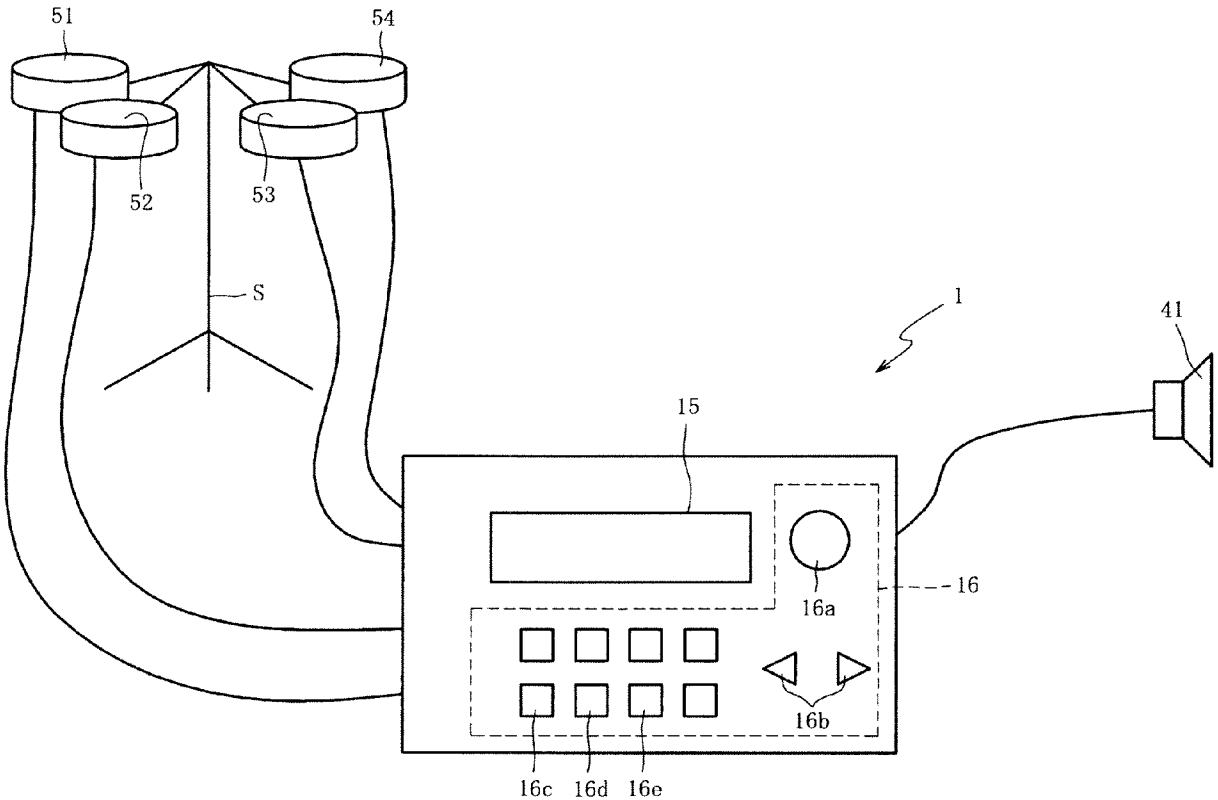
FIG. 1 is a schematic front view of a sound source device.

A preferred embodiment of the invention will be described with reference to the accompanying drawings. FIG. 1 is a schematic diagram of a front view of a sound source device 1. The sound source device 1 is provided with jacks (not shown in the figure) to connect with pads (striking surfaces). The pads are connected with the sound source device 1 by inserting terminals installed at the ends of cables extending from the pads in the jacks corresponding to the respective pads. The sound source device 1 generates a musical tone (tone) based on a strike on a connected pad, and outputs the tone.

In the example shown in FIG. 1, four pads 51-54 (tom-tom pads) set up on a stand S are connected with the sound source device 1. Therefore, the sound source device 1 generates a tone based on a strike on any of the pads 51-54. The sound source device 1 outputs the generated tone to a speaker 41 connected thereto. In further embodiments, the sound source device 1 is configured to be connectable to other pads (for instance, pads for a snare, a high-hat, etc.) other than the tom-tom pads 51-54.

Figure 2:
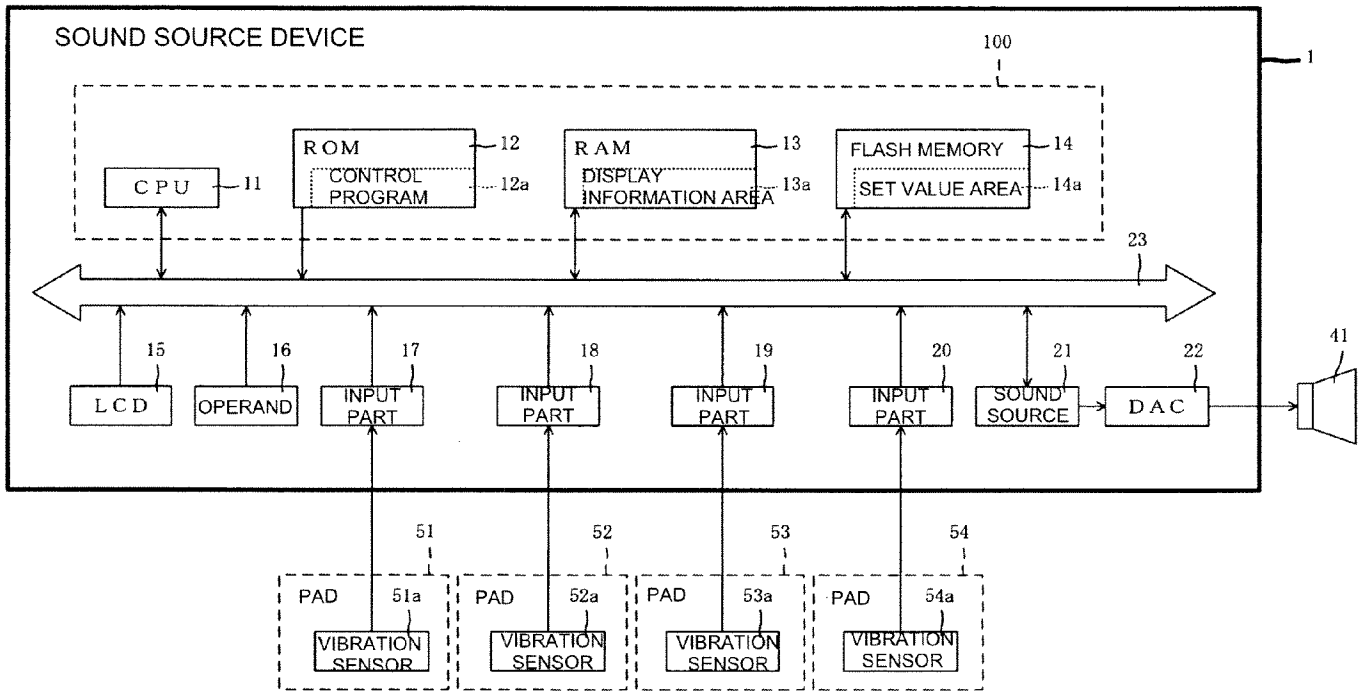
FIG. 2 is a block diagram of an electrical configuration of the sound source device.

An example embodiment of a tone generation control device 100 in the sound source device 1 is shown in the block diagram of FIG. 2. When a trigger signal representing vibration that triggers a tone generation is received from any of the connected pads (e.g., pads 51-54), the tone generation control device 100 executes crosstalk cancellation, if needed, based on the amount of crosstalk calculated for the trigger signal. In one example, the amount of crosstalk is a value indicative of the degree of crosstalk received from other pads (e.g., from comparison striking surfaces).

The tone generation control device 100 in the example embodiment of FIG. 2 displays the calculated amount of crosstalk on a display device, such as an LCD 15, regardless of whether crosstalk cancellation has actually been executed. Therefore, the user may set a certain pad as a target pad, and can observe and understand the degree of crosstalk that the target pad received from other pads according to the amount of crosstalk displayed, regardless of whether crosstalk cancellation has been executed. In addition, the tone generation control device 100 also displays crosstalk cancellation setting values to be used to determine whether or not crosstalk cancellation should be executed. The crosstalk cancellation setting values are displayed on a crosstalk monitor screen 61 (see FIG. 4) that also displays the calculated amount of crosstalk. The determination of whether or not to execute crosstalk cancellation determines whether or not a vibration is caused by crosstalk for which a tone generation instruction should not be output. Therefore, the user can set crosstalk cancellation setting values such that crosstalk cancellation can be appropriately executed, based on the displayed crosstalk cancellation setting values and the amount of crosstalk displayed on the crosstalk monitor screen 61.

Any suitable display device, including, but not limited to an LCD 15 may be employed for displaying various information described herein. In addition, operators 16 for user input are provided on the front face of the sound source device 1. The operators 16 may include any suitable manual operators such as, but not limited to one or more rotary encoders, buttons, knobs, touch-screen locations or the like. In the embodiment in FIG. 1, the operators 16 include a rotary encoder 16*a*, cursor movement buttons 16*b*, a selection button 16*c*, an ENTER button 16*d*, and an EXIT button 16*e*.

FIG. 2 is a block diagram showing an electrical configuration of the sound source device 1. The sound source device 1 includes a CPU 11, a ROM 12, a RAM 13, a flash memory 14, the LCD 15, operators 16, input parts 17-20, a sound source 21, and a digital-to-analog converter (DAC) 22. The tone generation control device 100 is composed of the CPU 11, the ROM 12, the RAM 13 and the flash memory 14. These parts 11-21 are mutually connected through a bus line 23. The pads 51-54 are connected with the input parts 17-20, respectively. The DAC 22 is connected with the sound source 21.

The CPU 11 is a central controlling unit composed of one or more processors that control each part of the sound source device 1 according to fixed values and one or more programs stored in the ROM 12 and data stored in the RAM 13 and the flash memory 14. The CPU 11 has a built-in timer (not shown in the figure) that measures clock signals to thereby measure time.

Figure 6:
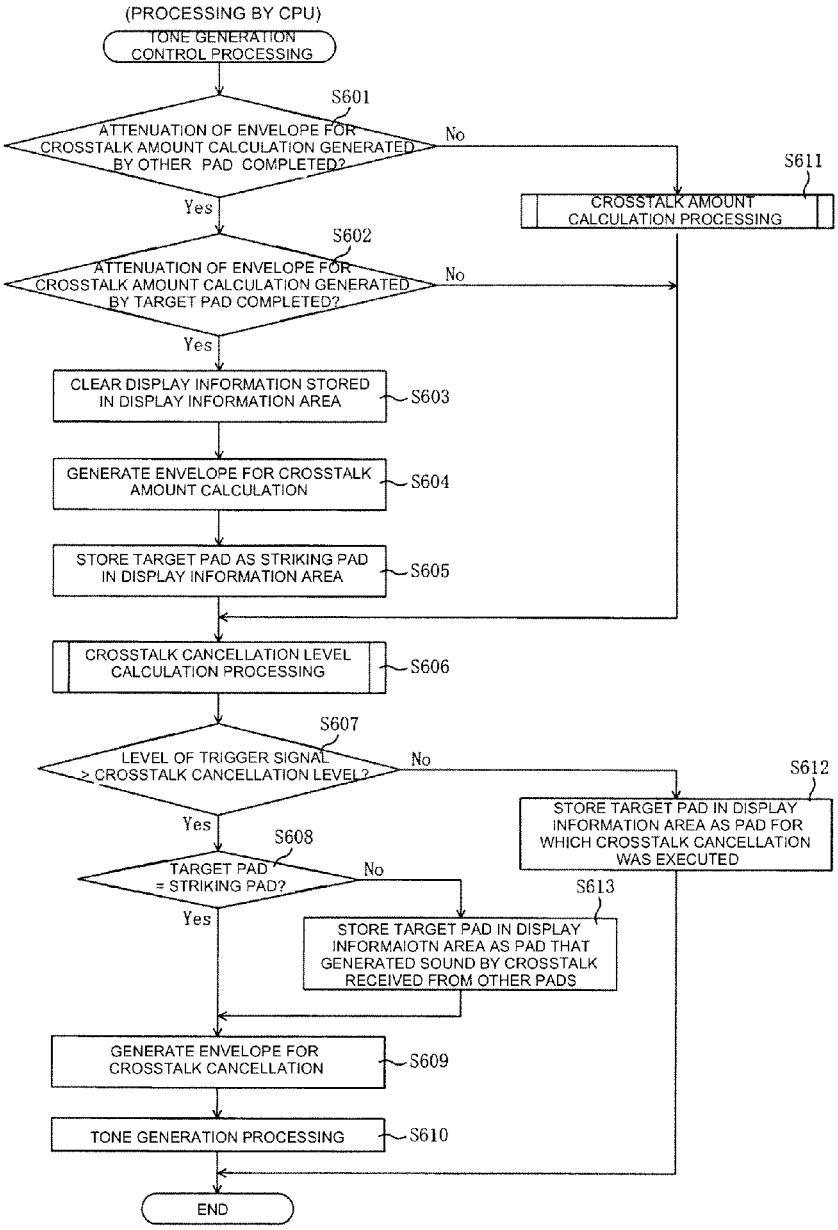
FIG. 6 is a flow chart of tone generation control processing.
Figure 7:
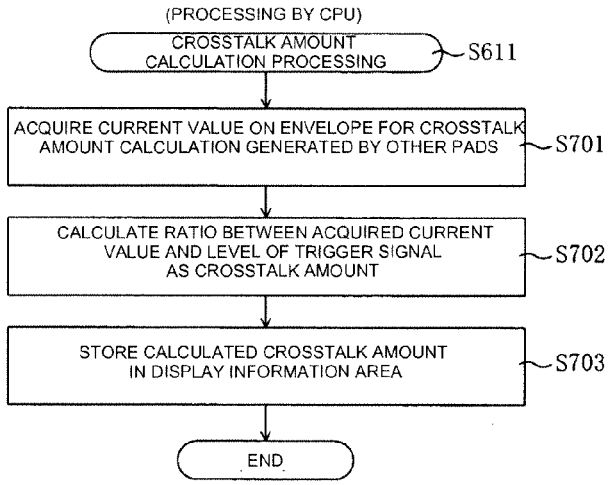
FIG. 7(*a*) is a flow chart of crosstalk amount calculation processing.
Figure 7:
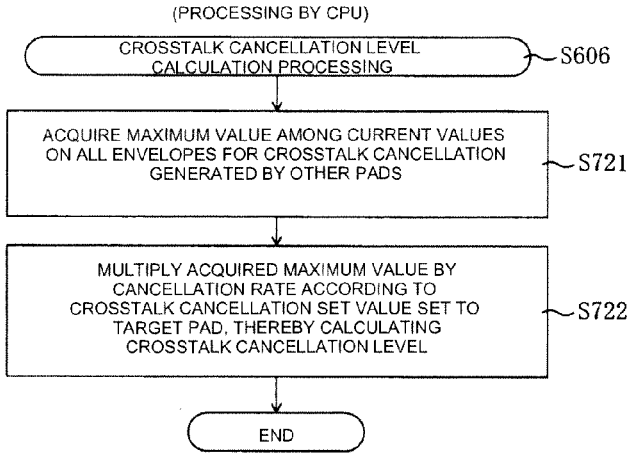
Figure 8:
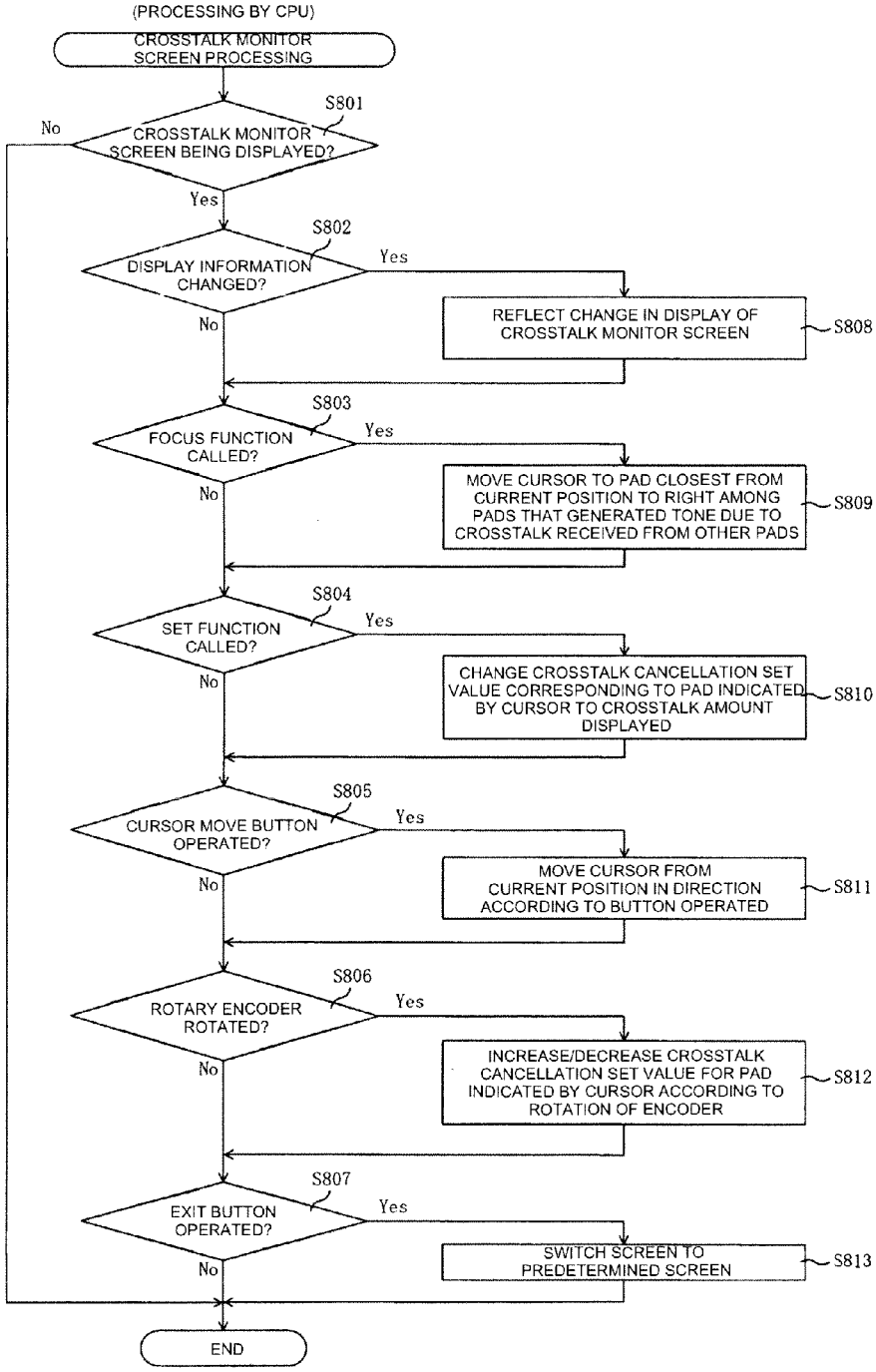
FIG. 8 is a flow chart of crosstalk monitor screen processing.

The ROM 12 is a non-rewritable nonvolatile memory. The ROM 12 stores one or more control programs 12*a* to be executed by the CPU 11 and the sound source 21, and fixed value data (not shown), etc. to be referred to by the CPU 11 when the control program 12*a* is executed. Each processing shown in the flow charts in FIGS. 6-8 is executed based on the control program 12*a*.

The RAM 13 is a rewritable volatile memory. The RAM 13 has a temporary area to store various data temporarily, when the CPU 11 executes the control program 12*a*. The temporary area in the RAM 13 includes a display information area 13*a* for storing various data to be displayed in a crosstalk monitor screen 61 (see FIG. 4). Further details of the display information area 13*a* are described with reference to FIG. 3(*a*).

The flash memory 14 is a rewritable nonvolatile memory. The flash memory 14 is provided with a setting value area 14*a* that stores crosstalk cancellation setting values. Further details of the setting value area 14*a* are described with reference to FIG. 3(*b*).

The input parts 17-20 are interfaces that connect with vibration sensors 51*a*-54*a* of the respective pads 51-54. Though omitted in FIG. 2, one or more further input parts similar to the input parts 17-20 may be included in the sound source device 1 for one or more additional connectable pads other than the pads 51-54.

In the following description, each of the input parts 17-20 has the same composition except that they connect to different pads. Accordingly, the input part 17 is described as a representative example of each of the input parts 17-20. An analog signal output from the vibration sensor 51*a* of the pad 51 is input to the sound source device 1 through the input part 17. An analog-to-digital converter (not shown in the figure) is built in the input part 17. The analog signal input from the vibration sensor 51*a* of the pad 51 is converted into a digital value by the analog-to-digital converter at a predetermined time interval, and output to the CPU 11. When a signal input from the vibration sensor 51*a* of the pad 51 through the input part 17, that exceeds a predetermined level for a predetermined period, is detected, the CPU 11 detects the peak of the signal as a trigger signal. When the trigger signal is detected, the CPU 11 determines whether or not a crosstalk cancellation is to be executed. When the CPU 11 determines that crosstalk cancellation is not to be executed, the CPU 11 outputs a tone generation instruction to the sound source 21, instructing the sound source 21 to output a tone with a timbre corresponding to the pad 51, with a sound volume corresponding to the amplitude level of the trigger signal. On the other hand, when the CPU 11 determines that crosstalk cancellation is to be executed, the CPU 11 does not output a tone generation instruction (that is, crosstalk cancellation is executed).

When the tone generation instruction is received from the CPU 11, the sound source 21 generates a tone with the timbre and the sound volume according to the tone generation instruction. A waveform ROM (not shown in the figure) is built in the sound source 21. Digital tones with timbres respectively corresponding to the pads 51-54 that can be generated by the sound source device 1 are stored in the waveform ROM. Moreover, a DSP (Digital Signal Processor) (not shown in the figure), that processes filters, effects, etc., is built in the sound source 21. When a tone generation instruction is input from the CPU 11, the sound source 21 reads out a digital tone with a timbre according to the tone generation instruction from the waveform ROM, executes predetermined processes such as, but not limited to, filter, effect, and the like, with the DSP, and outputs the processed digital tone to the DAC 22. The DAC 22 converts the input digital tone into an analog tone, and outputs the same to the speaker 41 connected with the sound source device 1. As a result, a tone based on the striking on the pad connected to the sound source device 1 is emanated from the speaker 41.

The display information area 13*a* is described with reference to FIG. 3(*a*). FIG. 3(*a*) is a schematic diagram representing memory contents stored in the display information area 13*a*. As shown in FIG. 3(*a*), areas 13*a*1-13*a*7 are provided in the display information area 13*a*. Information that specifies the pads connected with the sound source device 1 is stored in the areas 13*a*1-13*a*3 among the areas 13*a*1-13*a*7. The remainder areas 13*a*4-13*a*7 store information for display, corresponding to the pads respectively specified in the areas 13*a*1-13*a*3.

The area 13*a*1 is an area that stores numbers assigned to the respective jacks (not shown in the figure) (hereafter referred to as "jack numbers") in the sound source device 1. In the embodiment of FIG. 3, jack numbers 1-11 are stored in the area 13*a*1. In other words, eleven jacks are installed in the sound source device 1. In other embodiments, other suitable numbers of jacks may be included in the sound source device 1.

The area 13a2 stores the name of the terminal connected with each of the jack numbers. In the embodiment of FIG. 3, the characters K, S, T1, T2, T3, T4, HH, C1, C2, RD, and EG are assigned to represent the names of pad numbers 1-11, respectively. Respectively, K, S, T1, T2, T3, T4, HH, C1, C2, RD and EG indicate terminals extending from a kick, a snare, a $1^{st}$ tom-tom, a $2^{nd}$ tom-tom, a $3^{rd}$ tom-tom, a $4^{th}$ tom-tom, a high-hat, a first crash cymbal, a second crash cymbal, the bell of a ride cymbal, and the apron of the ride cymbal. Among the above-mentioned terminal names, T1, T2, T3 and T4 correspond to the terminals extending from the pads 51-54, respectively. In the following description, the bell and the apron of the ride cymbal, which are different parts of the same pad, are described as separate pads.

Connection flags associated with the respective jack numbers (that is, the respective pads) are in the area 13a3. The connection flag for a jack is a flag that indicates whether or not the jack of the corresponding jack number is connected with a terminal corresponding to the jack. For example, when the connection flag is set to a first state (such as 1), it indicates that the terminal corresponding to the jack is connected. On the other hand, when the connected flag is set to a second state (such as 0), it indicates that the terminal corresponding to the jack is not connected. The setting of the connection flag is changed according to whether the terminal corresponding to the jack is connected or not.

Striking flags associated with the respective corresponding jack numbers are provided in the area 13a4. The striking flag is a flag that indicates the result of a strike detection from a trigger signal input through a jack of the corresponding jack number. For example, when the striking flag is set to a first state (such as 1), it indicates that the CPU 11 determined that a trigger signal input through the corresponding jack is a signal caused by a strike. The example shown in FIG. 3(*a*) indicates that the CPU 11 judged that the trigger signal input from the pad 52 connected with the jack number 4 is a signal caused by a strike.

When the CPU 11 determines that a trigger signal input from a certain pad is a signal caused by a strike, the striking flag corresponding to the jack in which the trigger signal was input is set to the first state (such as 1). The striking flag set to the first state (such as 1) is later changed to a second state or cleared (such as cleared to zero), on condition that: (a) an envelope for crosstalk amount calculation 71 (see FIG. 5) of the target pad (that is, a target striking surface) is generated, when its attenuation is completed; and (b) envelopes for crosstalk cancellation 72 (see FIG. 5) of other pads (that is, comparison striking surfaces) are generated, when their attenuation is entirely completed. Moreover, when the striking flag for a certain pad is set, the striking flags for other pads are automatically cleared.

Crosstalk cancellation flags associated respectively with the corresponding jack numbers are provided in the area 13a5. The crosstalk cancellation flag is a flag that indicates whether or not crosstalk cancellation has been executed for a trigger signal input through a jack with the corresponding jack number. For example, when the crosstalk cancellation flag is set to a first state (such as 1), it indicates that crosstalk cancellation has been executed for the trigger signal input through the corresponding jack. The example shown in FIG. 3(*a*) indicates that crosstalk cancellation has been executed for the trigger signal input from the pad 53 connected with the jack number 5.

When crosstalk cancellation is executed for a trigger signal input from a certain pad, the crosstalk cancellation flag corresponding to the jack in which the trigger signal has been input is set to the first state (such as 1). The crosstalk cancellation flag set to the first state (such as 1) is later changed or cleared (such as cleared to 0), on condition that: (a) an envelope for crosstalk amount calculation 71 of the target pad is generated, when its attenuation is completed; and (b) envelopes for crosstalk cancellation 72 of other pads are generated, when their attenuation is entirely completed. Further, when the striking flag is set to the first state (such as 1), or when the terminal is pulled out, the corresponding crosstalk cancellation flag is cleared. Moreover, when a crosstalk flag described below is set, the corresponding crosstalk cancellation flag is cleared.

Crosstalk flags respectively associated with the corresponding jack numbers are provided in the area 13a6. The crosstalk flag is a flag indicative of whether or not a tone is generated due to crosstalk received from other pads. For example, when the crosstalk flag is set to a first state (such as 1), it indicates that the CPU 11 determined that a trigger signal input through the corresponding jack is a trigger signal caused by crosstalk received from other pads, and is a trigger signal that is not subject to execution of crosstalk cancellation (in other words, subject to tone generation). The example shown in FIG. 3(*a*) indicates that the CPU 11 determined that trigger signals input from the pads 51 and 54 connected with the jack numbers 3 and 6, respectively, were trigger signal caused by crosstalk received from other pads, and are subject to tone generation.

In the above example embodiment, when the CPU 11 determines that a trigger signal input from a certain pad is a trigger signal caused by crosstalk received from other pads, and is a trigger signal that is subject to tone generation, the crosstalk flag corresponding to the jack in which the trigger signal was input is set to the first state (such as 1). The crosstalk flag set to the first state (such as 1) is later changed or cleared to a second state (such as 0), on condition that: (a) an envelope for crosstalk amount calculation 71 of the target pad is generated, when its attenuation is completed; and (b) envelopes for crosstalk cancellation 72 of other pads are generated, when their attenuation is entirely completed. Moreover, when the striking flag is set to the first state (such as 1), or when the terminal is pulled out, the corresponding crosstalk flag is cleared. Moreover, when the above-described crosstalk cancellation flag is set to the first state (such as 1), the corresponding crosstalk flag is also cleared.

The amount of crosstalk associated with each of the jack numbers is stored in the area 13a7. The amount of crosstalk is a value indicative of the degree of crosstalk received from other pads. Though details will be described later, the amount of crosstalk is calculated based on the level (vibration level) of a trigger signal input from a certain pad and a crosstalk amount calculation envelope 71 generated based on a trigger signal input from other pads. When the amount of crosstalk is calculated for a trigger signal input from a certain pad, the calculated amount of crosstalk is stored in the area 13a7 in association with the jack in which the trigger signal was input. The stored crosstalk amount is later cleared on condition that: (a) an envelope for crosstalk amount calculation 71 of the target pad is generated, when its attenuation is completed; and (b) envelopes for crosstalk cancellation 72 of other pads are generated, when their attenuation is entirely completed. Moreover, when the striking flag is set to the first state (such as 1), or when the terminal is pulled out, the corresponding crosstalk amount is cleared.

The example shown in FIG. 3(*a*) indicates that the amount of crosstalk calculated for each of the trigger signals input from the pad 51, 53 and 54 is 18, 15 and 22, respectively. The trigger signal input from the pad for which the amount of crosstalk is calculated is a trigger signal that is determined to be a signal caused by crosstalk received from other pads. On the other hand, because the trigger signal input from the pad 52 is determined by the CPU 11 to have been caused by striking (the striking flag is set to the first state, such as 1), the amount of crosstalk is zero.

The above-mentioned setting value area 14*a* is described with reference to FIG. 3(*b*). FIG. 3(*b*) shows characters representing memory contents stored in the setting value area 14*a*. As shown in FIG. 3(*b*), the setting value area 14*a* is provided with the areas 14*a*1-14*a*3. The area 14*a*1 is an area where jack numbers are stored, like the area 13*a*1 described above. The area 14*a*2 stores the names of the terminals connected with the respective jack numbers, like the area 13*a*2 described above.

The area 14*a*3 stores crosstalk cancellation setting values associated with the respective corresponding jack numbers. The crosstalk cancellation setting value is a value to be used to determine whether or not to execute crosstalk cancellation with respect to a trigger signal input from a certain pad. More specifically, a threshold as to whether or not crosstalk cancellation is to be executed (a crosstalk cancellation level) is calculated with the crosstalk cancellation setting value. The greater the crosstalk cancellation setting value, the greater the crosstalk cancellation level becomes. In other words, the greater the value, the more difficult it becomes for crosstalk cancellation to be executed.

At the time of product shipment, the setting value area 14*a* (the area 14*a*3) stores initial values for the crosstalk cancellation setting values. The values at the time of product shipment are also stored in another area (not shown) in the ROM 12. In particular embodiments, the crosstalk cancellation setting values stored in the area 14*a*3 are configured in a manner that they can be changed for each of the pads according to the user's requirements. For example, as described in more detail below, the amount of crosstalk calculated for a pad at the position where the cursor is displayed can be set as a crosstalk cancellation setting value for the pad by operating a FOCUS button 61*d* and a SET button 61*e* in the crosstalk monitor screen 61 (see FIG. 4).

An example of a crosstalk monitor screen 61 displayed on the LCD 15 of the sound source device 1 (the tone generation control device 100) is described with reference to FIG. 4.

The crosstalk monitor screen 61 is a screen for monitoring the condition of mutual crosstalk and crosstalk cancellation for each of the pads connected with the sound source device 1. In addition, the crosstalk monitor screen 61 is also a setting screen for setting the crosstalk cancellation setting value for each of the pads.

Figure 4:
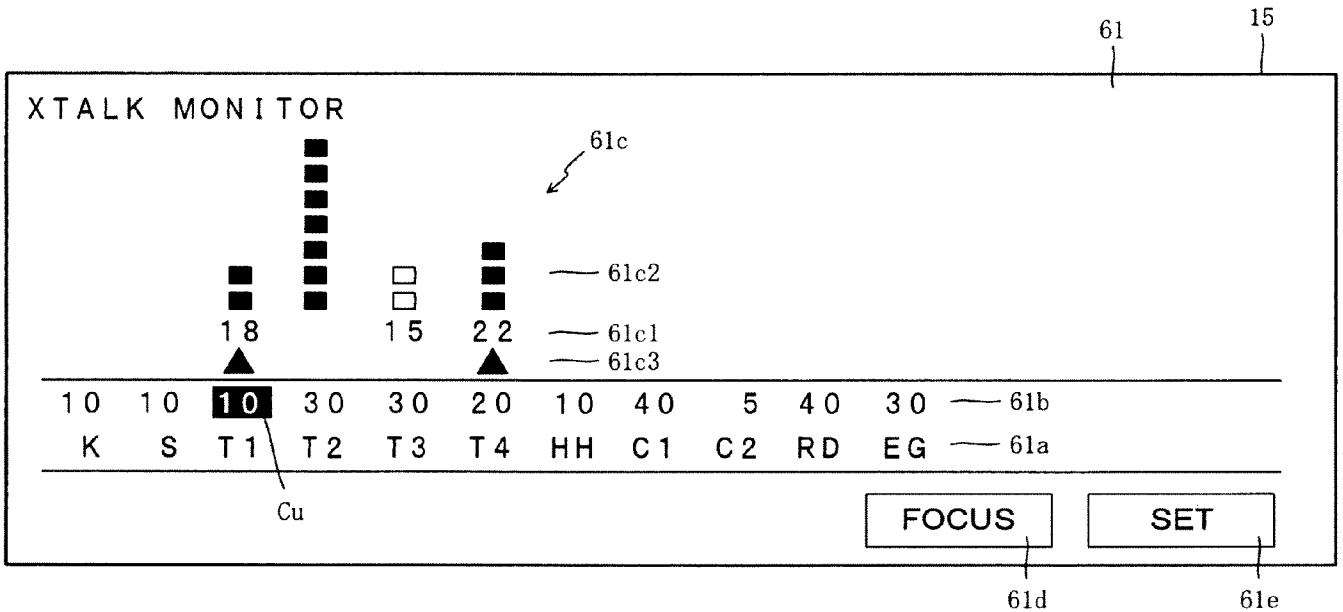
FIG. 4 is a schematic view of a crosstalk monitor screen.

As shown in FIG. 4, the crosstalk monitor screen 61 displays the pad names 61*a* (more specifically, the terminal names) that are connectable to the sound source device 1, the crosstalk cancellation setting values 61*b* of the respective pads, crosstalk information 61*c* for each of the pads, the FOCUS button 61*d*, and the SET button 61*e*.

The pad names 61*a* and the crosstalk cancellation setting values 61*b* are the terminal names and the crosstalk cancellation setting values stored in the setting value area 14*a*, respectively. The pad names 61*a* and the crosstalk cancellation setting values 61*b* are displayed in mutually association with the display of respective jack numbers (in the example shown in FIG. 4, they are arranged vertically in the display).

The crosstalk information 61*c* is composed of the amount of crosstalk 61*c*1, a bar chart 61*c*2, and marks 61*c*3. The amount of crosstalk 61*c*1 is the amount of crosstalk (the unit: %) calculated based on an envelope 71 for crosstalk amount calculation (see FIG. 5) generated from trigger signals from other pads. More specifically, values that exceed 0 among the amounts of crosstalk stored in the area 13*a*7 in the display information area 13*a* are displayed as the amounts of crosstalk 61*c*1.

The bar chart 61*c*2 shows the levels of the trigger signals input from the respective pads in the form of bars. The bar chart shows that the longer the length of the bar 61*c*2, the greater the level of the input trigger signal. The length of the bar 61*c*2 corresponds to the ratio of the input trigger signal with respect to the level of a trigger signal determined to have been caused by striking being 100.

According to particular embodiments, the tone generation control device 100 makes the mode of displaying the bar chart 61*c*2 different according to whether a tone is generated or not. For example, in a bar chart 61*c*2 for a pad that has not generated a tone, each of the blocks forming the bar chart is displayed as an outlined white block. In other words, for a pad for which the crosstalk cancellation flag stored in the area 13*a*5 in the display information area 13*a* is set to the first state (such as 1), each of the blocks forming the bar chart 61*c*2 is displayed as an outlined white block.

On the other hand, in a bar chart 61*c*2 for a pad that has generated a tone, each of blocks forming the bar chart is displayed as a solid black block. In other words, for a pad for which the striking flag stored in the area 13*a*4 in the display information area 13*a* is set to the first state (such as 1), and for a pad for which the crosstalk flag stored in the area 13*a*6 is set to the first state (such as 1), each of the blocks forming the bar chart 61*c*2 is displayed as a solid black block.

In the example shown in FIG. 4, each of the blocks of the bar chart 61*c*2 for T3 (the pad name 61*a*) is displayed as an outlined white block. In other words, the bar chart 61*c*2 indicates that crosstalk cancellation was executed for the trigger signal input from the pad 53, and a tone was not generated. On the other hand, each of the blocks of each of the bar charts 61*c*2 for T1, T2 and T4 (the pad name 61*a*) is displayed as a solid black block. In other words, the bar chart 61*c*2 shows that a tone has been generated for the trigger signals input from the pads 51, 52 and 54.

The mark 61*c*3 is displayed for a pad that was determined to have generated a tone by crosstalk received from other pads. In other words, the crosstalk information 61*c* identifies with the mark 61*c*3, each pad that was determined to have generated a tone by crosstalk received from other pads. More specifically, the mark 61*c*3 is displayed for a pad for which the crosstalk flag stored in the area 13*a*6 in the display information area 13*a* is set to the first state (such as 1). In the example shown in FIG. 4, solid black triangles (▲) are displayed for T1 and T4 (the pad name 61*a*) as the marks 61*c*3. That is, the crosstalk information 61*c* shows that the pads 51 and 54 were determined to have generated a tone by crosstalk received from other pads.

On the other hand, crosstalk cancellation has been executed for the pad for which the crosstalk amount 61*c*1 is displayed, but the bar chart 61*c*2 is shown by outlined white blocks (in other words, a pad, like T3, that has not generated tone). Thus, particular embodiments of the tone generation control device 100 change the display mode of pads that receive crosstalk, to display information differently from other pads, according to whether crosstalk cancellation was executed and whether a tone has been generated. Therefore, the user can easily observe and understand, by looking at the crosstalk monitor screen 61, whether or not crosstalk cancellation has been executed.

The FOCUS button 61*d* is a button to call a FOCUS function. The FOCUS function is a function that moves a cursor Cu to be displayed at the position where the crosstalk cancellation setting value is displayed only to a pad for which the mark 61c3 is displayed (in other words, the pad that has generated tone by crosstalk received from other pads). In other words, in the example shown in FIG. 4, each time the FOCUS function is called, the cursor Cu is alternately moved to one of the crosstalk cancellation setting values corresponding to T1 and T4 (the pad name 61a), where the mark 61c3 is displayed.

The SET button 61e is a button to call a SET function. The SET function is a function to update the crosstalk cancellation setting value corresponding to the position where the cursor Cu is displayed to the crosstalk amount 61c1 that is being displayed. Therefore, by the combination of the FOCUS function and the SET function, the crosstalk cancellation setting value for a pad that generated a tone due to crosstalk received from other pads can be changed to the amount of crosstalk actually calculated. In other words, the crosstalk cancellation setting value can be set to a level at which the crosstalk can be cancelled, if the trigger signal is at the same level.

When the ENTER button 16d (see FIG. 1) is operated while the FOCUS button 61d and the SET button 61e are in the selected state, the FOCUS function and the SET function are called. Moreover, each time the selection button 16c (see FIG. 1) is operated, the selected state of each of the buttons 61d and 61e is alternately switched.

The cursor Cu can also be moved by operating the cursor movement buttons 16b (see FIG. 1) on the crosstalk monitor screen 61. Each time one of the cursor movement buttons 16b is operated, the cursor Cu moves one by one to the direction (right side or left side) corresponding to which one of the buttons 16b is operated. When the cursor Cu is moved by operating the cursor movement button 16b, the crosstalk cancellation setting value at the position where the cursor Cu is displayed can be increased or decreased according to the rotation of the rotary encoder 16a (in the rotation direction by the rotation amount).

Figure 5:
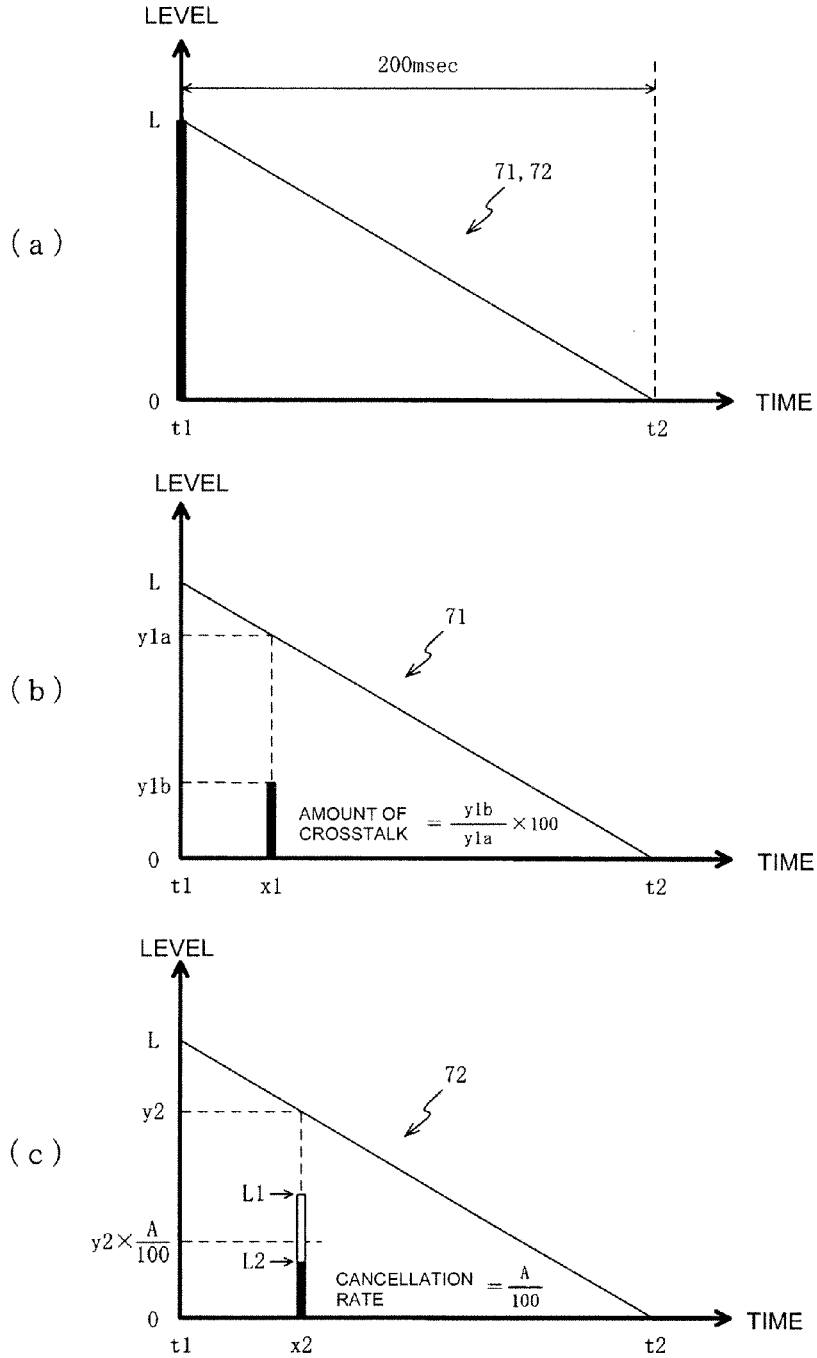
FIG. 5(*a*) is a graph showing shapes of an envelope for crosstalk amount calculation and an envelope for crosstalk cancellation.

Embodiments of the crosstalk amount calculation envelope 71 and the crosstalk cancellation envelope 72 are described with reference to FIG. 5. FIG. 5(a) is a graph showing the shapes of an example of the crosstalk amount calculation envelope 71 and the crosstalk cancellation envelope 72. In FIG. 5(a), a horizontal axis represents time and a vertical axis represents the level.

The crosstalk amount calculation envelope 71 is an envelope used for calculating a value indicative of the degree of crosstalk (that is, the amount of crosstalk) that a certain pad received from other pads. On the other hand, the crosstalk cancellation envelope 72 is an envelope used to determine whether or not crosstalk cancellation is to be executed for a trigger signal input from a certain pad.

The crosstalk amount calculation envelope 71 and the crosstalk cancellation envelope 72 are virtual envelopes that imitate the vibration of the pads (that is, target striking surfaces) that output trigger signals subject to generation of envelopes. The envelopes 71 and 72 are each generated based on the level of the trigger signal that is subject to generation of an envelope, as shown in FIG. 5(a). More specifically, when a trigger signal that is subject to generation of an envelope, is generated at time t1, the envelopes 71 and 72 are each expressed by a linear function in which the level L of the trigger signal at time t1 becomes zero at time t2 after a constant time (200 msec. in the embodiment). In other words, the greater the level of the trigger signal that is subject to generation of an envelope, the greater the downward inclination in both of the crosstalk amount calculation envelope 71 and the crosstalk cancellation envelope 72.

The trigger signal that is subject to generation of the crosstalk amount calculation envelope 71 is a trigger signal from a pad that is determined to have been struck. In other words, only one crosstalk amount calculation envelope 71 is generated with respect to the pad judged to have been struck.

On the other hand, the trigger signal that is subject to generation of the crosstalk cancellation envelope 72 is a trigger signal from a pad that is determined to have been struck or from a pad that is determined to have generated a tone due to crosstalk received from other pads. In other words, one or a plurality of crosstalk cancellation envelopes 72 is generated for a pad determined to have been struck and pads that have received crosstalk and generated a tone, in other words, for all of the pads that generated a tone. The crosstalk cancellation envelope 72 generated for a pad that is determined to have been struck has the same shape as that of the crosstalk amount calculation envelope 71 generated for the pad that is determined to have been struck.

A method of calculating the amount of crosstalk, using the crosstalk amount calculation envelope 71 is described with reference to FIG. 5(b). If the crosstalk amount calculation envelope 71 of another pad (that is, a comparison striking surface) has already been generated when a trigger signal is input from a certain pad (that is, a target striking surface), the amount of crosstalk is calculated as a ratio between the present value in the crosstalk amount calculation envelope 71 and the input trigger signal.

More specifically, when the level of a trigger signal input from a certain pad at time x1 is assumed to be y1b, and the current value at time x1 is assumed to be y1a on the envelope 71 for calculation of the amount of crosstalk generated by the other pad, the amount (%) of crosstalk that the certain pad received is calculated as $(y1b/y1a)\times 100$.

A method of determining, using the crosstalk cancellation envelope 72, whether or not to execute crosstalk cancellation is described with reference to FIG. 5(c). Whether or not to perform crosstalk cancellation for a trigger signal from a certain pad (that is, a target striking surface) is determined by using an envelope 72 with the current value at the time when the trigger signal was input being the maximum among the envelopes 72 for crosstalk cancellation being generated. More specifically, whether or not crosstalk cancellation is to be done for a trigger signal is determined by comparison between the crosstalk cancellation level and the level of the trigger signal. Here, the crosstalk cancellation level for a trigger signal is obtained by multiplying the current value (that is, the value at the time when the trigger signal is input) on the envelope for crosstalk cancellation to be used, by a cancellation rate specified for the pad that outputs the trigger signal (that is, a target striking surface). When the crosstalk cancellation level is greater than the level of the trigger signal, it is determined that the crosstalk cancellation is to be executed for the trigger signal. On the other hand, when the crosstalk cancellation level is smaller than the level of the trigger signal, it is determined that the crosstalk cancellation is not to be executed for the trigger signal.

The "cancellation rate" is a value obtained by dividing the crosstalk cancellation setting value set for each of the pads by 100. In other words, when the crosstalk cancellation setting value is A, the cancellation rate is expressed as A/100. When determining whether or not to perform crosstalk cancellation for a trigger signal, the crosstalk cancellation setting value set for the pad that is the output source of the trigger signal is used as the value A (the crosstalk cancellation setting value).

More specifically, among one or a plurality of envelopes 72 for crosstalk cancellation being generated, when the maximum value among the current values is y2 at time x2 when a trigger signal was input from a certain pad, the level of the input trigger signal and the level for crosstalk cancellation, that is y2×(A/100), are compared. (A/100) is a cancellation rate specified for the pad that is the output source of the trigger signal. In this case, for example, if the level of the trigger signal input from the certain pad is L2 that is smaller than y2×(A/100), it is determined that crosstalk cancellation is to be executed for the trigger signal. On the other hand, if the level of the trigger signal is L1 that is greater than y2×(A/100), it is determined that crosstalk cancellation is not to be executed for the trigger signal, in other words, the trigger signal is subject to tone generation.

Processing executed by the CPU 11 of the sound source device 1 (the tone generation control device 100) is described with reference to FIG. 6 through FIG. 8. FIG. 6 is a flow chart that shows tone generation control processing that the CPU 11 executes. When a trigger signal (the peak of the signal that exceeds a predetermined level for a predetermined period) from a pad is detected, the CPU 11 executes tone generation control processing. Tone generation control processing is executed for each of the pads connected with the sound source device 1. Because the pads 51-54 (the vibration sensors 51*a*-54*a*) are connected with the sound source device 1 in the illustrated embodiment, the tone generation control processing is executed for each of the pads 51-54, respectively. Accordingly, the tone generation control processing executed for the pad 51 (a target pad) is described as a representative example, which is similarly applicable to the other pads (the pads 52-54 and other pads that may be connected with the sound source device 1).

In tone generation control processing, first, the CPU 11 determines whether or not attenuation of the envelope for crosstalk amount calculation 71 generated by another pad (any one of the pads among the pads 52-54) has been completed (S601). Further, the CPU 11 determines whether or not attenuation of the envelope for crosstalk amount calculation 71 generated by the target pad (the pad 51) has been completed (S602).

When the CPU 11 determines that attenuation of the envelope for crosstalk amount calculation 71 generated by the other pad has been completed, and attenuation of the envelope for crosstalk amount calculation 71 generated by the target pad has been completed (S601: Yes, S602: Yes), the CPU 11 shifts the processing to S603. In S603, the CPU 11 considers that the input trigger signal was generated by a strike on the target pad, and clears the display information stored in the display information area 13*a*, that is, the memory content of the areas 13*a*4-13*a*7 (S603).

Next, the CPU 11 generates an envelope for crosstalk amount calculation 71 according to the level of the trigger signal of the target pad (S604). Next, the CPU 11 designates the target pad in the display information area 13*a* as a striking pad (S605) and shifts the processing to S606. More specifically, in S605, the CPU 11 sets the striking flag corresponding to the target pad in the display information area 13*a* to the first state (such as 1).

On the other hand, when the CPU 11 determines that attenuation of the envelope for crosstalk amount calculation 71 generated by the other pad has not been completed yet (S601: No), the CPU 11 executes crosstalk amount calculation processing (S611), and then shifts the processing to S606. Crosstalk amount calculation processing (S611) calculates the amount (%) of crosstalk of the target pad, further details of which are described, below, with reference to FIG. 7(*a*). In other words, it is possible that a trigger signal that is input in a state where attenuation of envelopes for crosstalk amount calculation 71 generated by other pads has not been completed yet, may be a trigger signal that is caused by crosstalk from a strike on one or more of the other pads. Therefore, the amount of crosstalk is calculated by the crosstalk amount calculation processing (S611).

Moreover, when the CPU 11 determines that attenuation of the envelope for crosstalk amount calculation 71 generated by the other pads has all been completed but attenuation of the envelope for crosstalk amount calculation 71 generated by the target pad has not been completed yet (S601: Yes, S602: No), the CPU 11 shifts the processing to S606. It is assumed that the above-mentioned condition, where attenuation of the envelope for crosstalk amount calculation 71 generated by the other pads has all been completed, but the attenuation of the envelope 71 for crosstalk amount calculation generated by the target pad has not been completed yet, may occur when relatively large trigger signals have been input at times in proximity to each other, such as, when the target pad is struck repeatedly. Therefore, in such a case, the CPU 11 shifts the processing to S606 so that the envelope for crosstalk amount calculation 71 is not generated repeatedly.

In S606, the CPU 11 executes crosstalk cancellation level calculation processing (S606). Crosstalk cancellation level calculation processing (S606) calculates a crosstalk cancellation level that is the threshold used to determine whether or not to execute crosstalk cancellation. Further details are described below, with reference to FIG. 7(*b*).

After executing crosstalk cancellation level calculation processing (S606), the CPU 11 determines whether or not the level of the trigger signal exceeds the calculated crosstalk cancellation level (S607). When the CPU 11 determines that the level of the trigger signal exceeds the calculated crosstalk cancellation level (S607: Yes), the CPU 11 then determines whether or not the target pad is a striking pad (S608). More specifically, the CPU 11 determines in S608 whether or not the target pad is a striking pad, based on the value of the striking flag corresponding to the target pad in the display information area 13*a*.

If the CPU 11 determines in S608 that the target pad is not a striking pad (S608: No), the CPU 11 designates the target pad in the display information area 13*a* as a pad that generated sound due to crosstalk received from other pads (S613), and shifts the processing to S609. More specifically, in S613, the CPU 11 sets the crosstalk flag corresponding to the target pad in the display information area 13*a* to the first state (such as 1). On the other hand, in S608, if the CPU 11 determines that the target pad is a striking pad (S608: Yes), the CPU 11 shifts the processing to S609.

In S609, the CPU 11 generates an envelope for crosstalk cancellation 72 according to the level of the trigger signal of the target pad (S609). Next, the CPU 11 executes tone generation processing (S610) and ends tone generation control processing. More specifically, in S610, the CPU 11 outputs a tone generation instruction to the sound source 21 to generate the tone of the target pad (the pad 51).

On the other hand, in S607, when the CPU 11 determines that the level of the trigger signal is below the crosstalk cancellation level calculated (S607: No), the CPU 11 designates the target pad in the display information area 13*a* as a pad for which the crosstalk cancellation has been executed (S612), and ends this processing. More specifically, in S612, the CPU 11 sets the crosstalk cancellation flag corresponding to the target pad in the display information area 13*a* to the first state (such as 1). Therefore, when the input trigger signal is below the crosstalk cancellation level, tone generation processing (S610) is not executed; in other words, crosstalk cancellation is executed.

FIG. 7(*a*) is a flow chart that shows crosstalk amount calculation processing (S611) described above. In crosstalk amount calculation processing (S611), first, the CPU 11 acquires the current value of the envelope for crosstalk amount calculation 71 generated by the other pad (any one of the pads among the pads 52-54) (S701). Next, the CPU 11 calculates the ratio between the current value acquired in S701 and the level of the trigger signal as a crosstalk amount (%) (S702). The crosstalk amount calculated in S702 corresponds, for example, to (y1*b*/y1*a*)×100 shown in FIG. 5(*b*) described above.

Next, the CPU 11 stores the calculated crosstalk amount in the display information area 13*a* (S703), and ends this processing. More specifically, in S703, the CPU 11 stores the calculated crosstalk amount as an amount of crosstalk corresponding to the target pad in the display information area 13*a*.

FIG. 7(*b*) is a flow chart that shows crosstalk cancellation level calculation processing (S606) described above. In crosstalk cancellation level calculation processing (S606), first, the CPU 11 acquires the maximum value among the current values in all the envelopes for crosstalk cancellation 72 that other pads (the pads 52-54) generated (S721).

In S601 and S602 described above, when the CPU 11 determines that attenuation of all the envelopes for crosstalk amount calculation 71 generated by the target pad and the other pads has been completed, the CPU 11 treats the level of the envelope for crosstalk cancellation 72 as 0 in S721. In other words, the foregoing case corresponds to a case where one of the pads is first struck.

Next, the CPU 11 multiplies the maximum value among the current values acquired in S721 by a cancellation rate corresponding to the crosstalk cancellation setting value set to the target pad (the pad 51) to acquire the crosstalk cancellation level (S722), and ends this processing. The cancellation rate used in S722 corresponds, for example, to (A/100) shown in FIG. 5(*c*) described above. Moreover, the crosstalk cancellation level calculated in S722 corresponds to, for example, y2×(A/100) shown in FIG. 5(*c*) described above.

FIG. 8 is a flow chart showing crosstalk monitor screen processing executed by the CPU 11. Crosstalk monitor screen processing executes the control of the display of the crosstalk monitor screen 61. Crosstalk monitor screen processing is executed periodically (for example, each 1 msec.) in main processing (not shown in the figure).

In crosstalk monitor screen processing, when the CPU 11 determines that the crosstalk monitor screen 61 is not being displayed (S801: No), the CPU 11 ends this processing. On the other hand, when the CPU 11 determines that the crosstalk monitor screen 61 is being displayed (S801: Yes), the CPU 11 shifts the processing to S802.

In S802, the CPU 11 determines whether or not display information in the display information area 13*a* has been changed (updated or cleared) in processing executed in the flow charts shown in FIG. 6 and FIG. 7 described above. When the CPU 11 determines that the display information has been changed (S802: Yes), the CPU 11 reflects the change in the display of the crosstalk monitor screen 61 (S808) and shifts the processing to S803. On the other hand, when the CPU 11 determines that the display information has not been changed (S802: No), the CPU 11 shifts the processing to S803.

In S803, the CPU 11 determines whether or not the FOCUS function has been called (S803). The FOCUS function is called when the ENTER button 16*d* is operated while the FOCUS button 61*d* in the crosstalk monitor screen 61 is in the selected state. When the CPU 11 determines that the FOCUS function has not been called (S803: No), the CPU 11 shifts the processing to S804.

On the other hand, when the CPU 11 determines that the FOCUS function has been called (S803: Yes), the CPU 11 moves the cursor Cu to the display position of a pad displayed closest to the right from the present location among the pads that are generating tone by crosstalk received from other pads (in other words, among the pads for which the mark 61*c*3 is displayed) (S809). In S809, if the FOCUS function is called when the cursor Cu is displayed at the position of a pad located on the rightmost side among the pads for which the mark 61*c*3 is displayed, the cursor Cu is moved to the display position of a pad located on the leftmost side among the pads for which the mark 61*c*3 is displayed. For example, when the FOCUS function is called in the display state of the crosstalk monitor screen 61 shown in FIG. 4, the cursor Cu moves to the position of the crosstalk cancellation setting value corresponding to T4 (the pad 54). The cursor Cu would not be moved, even when the FOCUS function is called, if there is no pad for which the mark 61*c*3 is displayed.

In S804, the CPU 11 determines whether or not the SET function has been called (S804). The SET function is called, when the ENTER button 16*d* is operated while the SET button 61*e* in the crosstalk monitor screen 61 is in the selected state. When the CPU 11 determines that the SET function has not been called (S804: No), the CPU 11 shifts the processing to S805.

On the other hand, when the CPU 11 judges that the SET function has been called (S804: Yes), the CPU 11 updates the crosstalk cancellation setting value stored in the setting value area 14*a* for the pad at the position where the cursor Cu is displayed, to the crosstalk amount 61*c*1 displayed (S810), and shifts the processing to S805. In S810, when the crosstalk cancellation setting value stored in the setting value area 14*a* is updated, the CPU 11 reflects the value in the display of the crosstalk monitor screen 61. In other words, the crosstalk cancellation setting value 61*b* after the update is displayed.

In S805, the CPU 11 determines whether or not the cursor movement button 16*b* has been operated (S805). When the CPU 11 determines that the cursor movement button 16*b* has not been operated (S805: No), the CPU 11 shifts the processing to S806.

On the other hand, when the CPU 11 determines that the cursor movement button 16*b* has been operated (S805: Yes), the CPU 11 moves the cursor Cu from the present location in the direction corresponding to the button operated (S811), and shifts the processing to S806. In particular embodiments, in S811, when the button for movement to the right (or to the left) is operated among the cursor movement buttons 16*b*, while the cursor Cu is displayed at the pad on the rightmost position (or at the leftmost position) as viewed toward the screen, the cursor Cu is moved to the pad on the leftmost side (or on the rightmost side) as viewed toward the screen.

In S806, the CPU 11 determines whether or not the rotary encoder 16*a* has been rotated (operated) (S806). When the CPU 11 determines that the rotary encoder 16*a* has not been rotated (S806: No), the CPU 11 shifts the processing to S807.

On the other hand, when the CPU 11 determines that the rotary encoder 16*a* has been rotated (S806: Yes), the CPU 11 increases or decreases the crosstalk cancellation setting value stored in the setting value area 14*a* for the pad at the position where the cursor Cu is displayed, by an amount corresponding to the amount of rotation of the encoder 16*a* (and in the direction of the rotation) (S812), and shifts the processing to S807. In S812, when the crosstalk cancellation setting value stored in the setting value area 14*a* is changed, the CPU 11 reflects the value in the display of the crosstalk monitor screen 61.

In S807, the CPU 11 determines whether or not the EXIT button 16*e* has been operated (S807). When the CPU 11 determines that the EXIT button 16*e* has not been operated (S807: No), the CPU 11 ends this processing. On the other hand, when the CPU 11 determines that the EXIT button 16*e* has been operated (S807: Yes), the CPU 11 switches the crosstalk monitor screen 61 being displayed to a predetermined screen (for example, the base screen displayed initially when the power supply is turned on) (S813), and ends this processing.

According to the above-described embodiment of the sound source device 1 (the tone generation control device 100), the crosstalk amount 61*c*1 is displayed on the crosstalk monitor screen 61. At the same time, the crosstalk cancellation setting value 61*b* set to each of the pads is also displayed on the crosstalk monitor screen 61. Therefore, the user can observe and understand the crosstalk condition for each of the pads, based on the crosstalk cancellation setting value 61*b* and the crosstalk amount 61*c*1 displayed on the crosstalk monitor screen 61. For example, from the comparison between the crosstalk cancellation setting value 61*b* and the crosstalk amount 61*c*1, it is possible to determine whether the crosstalk cancellation setting value 61*b* is a proper value, or is not a proper value and should be changed.

Because the crosstalk amount 61*c*1 is displayed regardless of whether the crosstalk cancellation has been executed, it is possible to determine whether or not the crosstalk cancellation setting value 61*b* is a proper value, not only for a pad for which tone is generated due to crosstalk received from other pads, but also for a pad for which the crosstalk cancellation has been executed.

The crosstalk monitor screen 61 displays, in addition to the crosstalk amount 61*c*1, the display mode that can identify the success or failure of the crosstalk cancellation (more specifically, the combination of the display mode of the bar chart 61*c*2 and the presence or absence of the mark 61*c*3). Therefore, the user can easily understand the success or failure of the crosstalk cancellation by visually observing the crosstalk monitor screen 61. Accordingly, the user can more readily understand the condition of the crosstalk of each pad, and can easily set the crosstalk cancellation setting value 61*b* appropriately.

Moreover, a pad that generates a tone caused by crosstalk received from other pads is automatically selected by calling the FOCUS function. In addition, the crosstalk cancellation setting value set for the pad selected by the FOCUS function can be updated to the crosstalk amount actually calculated, by calling the SET function. Therefore, the crosstalk cancellation setting value can be set to a proper value by a relatively simple operation.

Moreover, according to the above-described embodiment of the sound source device 1 (the tone generation control device 100), the amount of crosstalk of a certain pad (a target pad) is calculated based on the ratio between the current value on a virtual envelope that imitates the vibration situation of another pad (the envelope for crosstalk amount calculation 71) and the level of a trigger signal from the target pad. In other words, the amount of crosstalk of the target pad is calculated based on the level of vibration (the trigger signal) of the target pad and the level of vibration of the other pad that changes with time. Accordingly, because the amount of crosstalk can be calculated as a value that does not depend on the positional relation of the pads, appropriate crosstalk cancellation can be performed, while improving the flexibility and degree of freedom in which the plural pads can be arranged.

Moreover, the crosstalk cancellation level is calculated based on a virtual envelope that imitates the vibration situation of another pad (the envelope for crosstalk cancellation 72) and the level of the trigger signal from the target pad. Therefore, appropriate crosstalk cancellation can be performed while improving the flexibility and degree of freedom in which the plural pads can be arranged, because the crosstalk cancellation level can be calculated as a value that does not depend on the positional relation of the pads.

Example embodiments of the invention have been described above. However, the invention need not be limited in any particular manner to the embodiments described above, and various improvements and changes can be made without departing from the subject matter of the invention.

For example, the numerical values enumerated in the above-described embodiment are one example. Other embodiments employ other suitable numerical values.

Also, the above-described embodiment is configured such that one crosstalk cancellation setting value is set for each one pad. However, other example embodiments may be configured such that each pad is provided with a matrix of crosstalk cancellation setting values associated respectively with the other pads.

In example embodiments in which each of the pads is provided with such a matrix, an envelope for crosstalk amount calculation 71 is generated for each of the pads determined to have been struck. Then, when a trigger signal is detected on a certain pad (a target pad), the amounts of crosstalk may be calculated based on all the envelopes for crosstalk amount calculation 71 generated by the other pads, respectively.

Also, in such example embodiments, for calculating the crosstalk cancellation level, each of the envelopes for crosstalk cancellation 72 generated respectively for the other pads may be multiplied by the cancellation rate respectively corresponding to the target pad and each of the other pads (the crosstalk cancellation setting value/100) and, then, the maximum value among them may be selected.

Moreover, embodiments described above use a virtual envelope to imitate the vibration situation of a pad as the envelope for crosstalk amount calculation 71 and the envelope for crosstalk cancellation 72. In other embodiments, an envelope of actual vibration in a pad may be used as the envelope for crosstalk amount calculation 71 and/or the envelope for crosstalk cancellation 72.

Moreover, in embodiments described above, virtual envelopes expressed by a linear function (a straight line) in which the value decreases with the passage of time are adopted for each of the envelopes 71 and 72. In other embodiments, a function (for example, an exponential function, etc.) other than a linear function may be adopted, as long as the value decreases with the passage of time. Moreover, a combination of plural different kinds of functions may be used, where the function eventually reaches zero without increasing its level. Moreover, in further embodiments, the envelope for crosstalk amount calculation 71 and the envelope for crosstalk cancellation 71 are provided in a table.

Moreover, in embodiments described above, the envelope for crosstalk amount calculation 71 and the envelope for crosstalk cancellation 72 are each assumed to be an envelope in which the time for its level to reach zero, from its generation, is fixed (for example, 200 msec.) For example, in an embodiment in which the envelope 71 or 72 is expressed as a linear function, the inclination of the linear function differs according to the level of the trigger signal. In other embodiments, envelopes having a constant inclination may be used as the envelopes 71 and 72. Alternatively, further embodiments use envelopes that decreases at a constant rate from its generation, without depending on the level of the trigger signal. In such further embodiments, the greater the level of the trigger signal, the longer it takes for the level to reach zero.

Moreover, in embodiments described above, both the envelope for crosstalk amount calculation 71 and the envelope for crosstalk cancellation 72 are generated for a pad that is determined to have been struck. However, other embodiments use a common (the same) envelope for both of the cases of calculating the amount of crosstalk and calculating the crosstalk cancellation level.

Moreover, in embodiments described above, envelopes for crosstalk cancellation 72 in which the level L of a trigger signal becomes zero after a fixed predetermined time are generated, and the maximum value among the current values on the envelopes for crosstalk cancellation 72 is multiplied by the cancellation rate, thereby calculating the crosstalk cancellation level. In contrast, in other embodiments, an envelope for crosstalk cancellation 72 in which the level obtained in advance by multiplying the level L of a trigger signal with the cancellation rate becomes zero after a predetermined fixed time may be generated, and the maximum value among the current values on the envelopes for crosstalk cancellation 72 may be used as the crosstalk cancellation level.

Moreover, in embodiments described above, the crosstalk cancellation setting value is changed by the user on the crosstalk monitor screen 61. However, in other embodiments, when the amount of crosstalk is calculated for a certain pad (a target pad), the crosstalk cancellation setting value set for the target pad may be automatically updated to the amount of crosstalk calculated. According to such embodiments, each time the user strikes a pad, the crosstalk cancellation setting value set for a pad for which the amount of crosstalk is calculated based on the striking (in other words, a pad that receives crosstalk based on the striking of another pad) can be automatically updated to the amount of crosstalk actually calculated. Therefore, the crosstalk cancellation setting value can be set to an appropriate value by a relatively simple operation.

Figure 9:
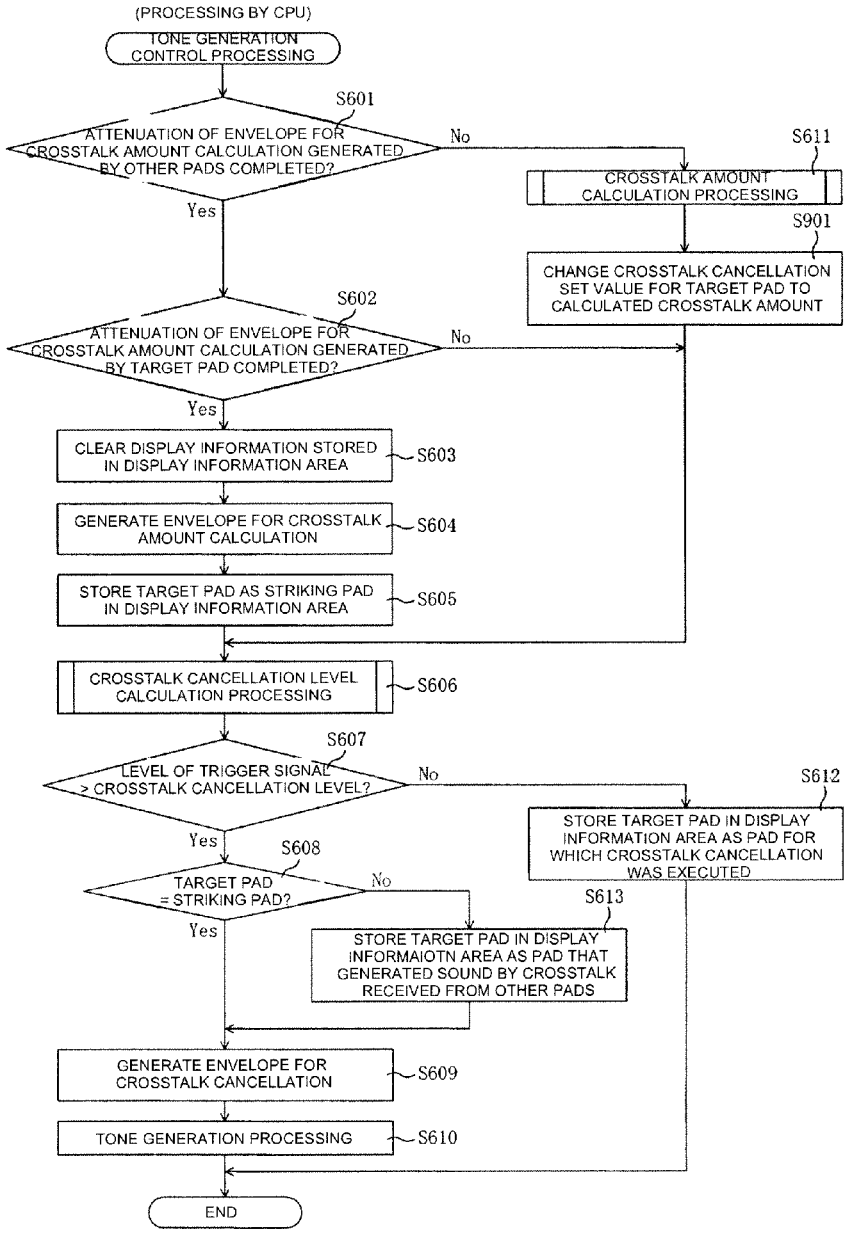
FIG. 9 is a flow chart of tone generation control processing in accordance with a further example.
Figure 10:
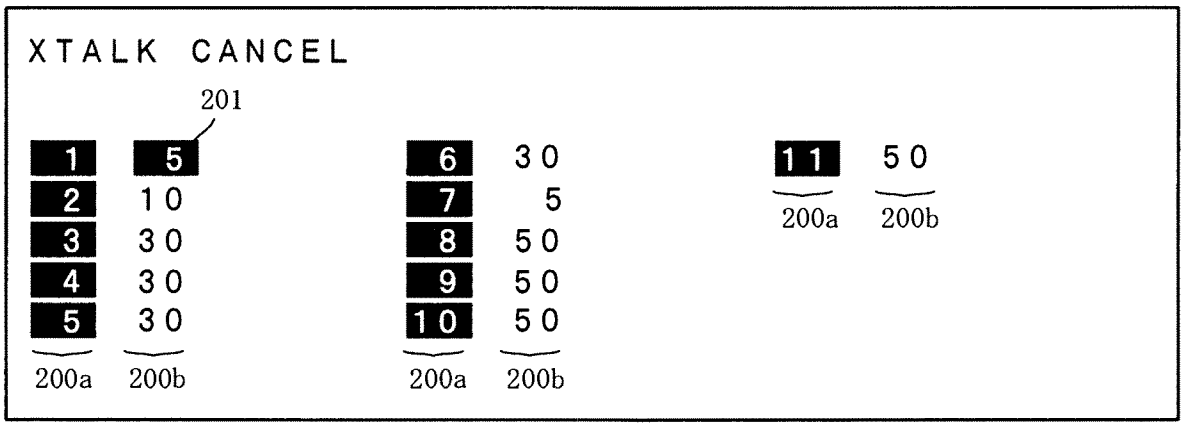
FIG. 10 represents a conventional screen for changing setting values for crosstalk cancellation.

FIG. 9 is a flow chart that shows tone generation control processing in accordance with the example embodiment described in the previous paragraph. In FIG. 9, the same reference characters are assigned to the same components as those of the above-described embodiment, and reference is made to the above descriptions of those components. Tone generation control processing of the embodiment in FIG. 9 is executed when the sound source device 1 is set to a special mode to automatically change the crosstalk cancellation setting value.

The tone generation control processing in the embodiment in FIG. 9 is different from the tone generation control processing in FIG. 6, in that processing in S901 is executed after the CPU 11 executes crosstalk amount calculation processing (S611). More specifically, when the CPU 11 determines, in S601, that attenuation of the envelope for crosstalk amount calculation 71 that other pads generated has not yet been completed (S601: No), the CPU 11 executes crosstalk amount calculation processing (S611). Next, the crosstalk cancellation setting value stored in the setting value area 14*a* for the target pad is updated to the amount of crosstalk calculated (S901).

In the further embodiment described above, the crosstalk cancellation setting value may be changed to the amount of crosstalk calculated, but only for those of the pads (among pads for which the amount of crosstalk is calculated) that generated tone without the crosstalk cancellation having been executed.

Moreover, in embodiments described above, when the SET function is called, the crosstalk cancellation setting value corresponding to a pad at the position where the cursor Cu is displayed is updated to the displayed crosstalk amount 61*c*1 (that is, the calculated amount of crosstalk). In other embodiments, instead of using the calculated crosstalk amount, itself, a different value that is obtained based on the calculated crosstalk amount may be set as a crosstalk cancellation setting value.

For example, the value obtained based on the calculated crosstalk amount may be: 1. a value in which the calculated crosstalk amount (%) is multiplied by a predetermined coefficient of 1 or more; 2. a value in which a predetermined point number is added to the calculated crosstalk amount (%); 3. the maximum value among the crosstalk amounts (%) calculated based on striking on other plural pads, respectively; 4. the maximum value among the crosstalk amounts (%) calculated based on striking multiple times on one or plural other pads, respectively; and 5. a value that is suitably selected according to the situation from among the above-described values. This further embodiment may also be employed with the further embodiment described above with reference to FIG. 9 in which the crosstalk cancellation setting value is automatically changed.

Moreover, in embodiments described above, when the FOCUS function is called, the cursor Cu is moved only to pads for which the mark 61*c*3 is displayed (in other words, pads that generated a tone by crosstalk received from other pads). In other embodiments, all pads for which the crosstalk amount 61*c*1 is displayed may be made as targets to which the cursor Cu is moved by the FOCUS function. In other words, pads for which the crosstalk amount 61*c*1 is displayed but the mark 61*c*3 is not displayed (that is, pads for which the crosstalk cancellation is executed) may be included as targets to which the cursor Cu is moved by the FOCUS function. As a result, when the crosstalk cancellation setting value is too large with respect to the amount of crosstalk, though the crosstalk cancellation has been executed, the crosstalk cancellation setting value can be readily changed to an appropriate value by the combination of the FOCUS function and the SET function.

Furthermore, in embodiments described above, the crosstalk amount 61*c*1, the bar chart 61*c*2, and the mark 61*c*3 are displayed as crosstalk information 61*c* to be displayed on the crosstalk monitor screen 61. In other embodiments, one or both of the bar chart 61*c*2 and the mark 61*c*3 is not displayed, while at least the crosstalk amount 61*c*1 is displayed. In such embodiments, the user can determine whether or not crosstalk cancellation has been executed, from the relation in magnitude between the crosstalk amount 61*c*1 and the crosstalk cancellation setting value 61*b* corresponding to each pad. However, it can be easier for the user to observe and understand the crosstalk condition, by displaying the marks 61*c*3, and changing the display mode of the bar charts 61*c*2.

Also, in embodiments described above, the crosstalk amount 61*c*1 on the crosstalk monitor screen 61 is displayed as a numerical value. In another embodiment, the crosstalk amount 61*c*1 may be displayed by other suitable indicia capable of informing the user of the magnitude of the crosstalk amount, such as, a bar chart, the size of a figure, etc. In such embodiments, depending on whether the pad is one for which the crosstalk cancellation has been executed or one that has generated tone due to crosstalk received from other pads, the display mode of the bar chart or the figure (for example, the presence/absence of a solid shape or coloring, etc.) may be made different.

Further, in embodiments described above, the mark 61*c*3 is displayed for the pad that has generated tone due to crosstalk received from other pads. In other embodiments, for a pad for which the crosstalk cancellation has been executed, a mark may be displayed in a display mode different from that of a pad that generated a tone due to crosstalk received from other pads (for example, presence/absence of painting-out or coloring in a figure, difference in the shape of a figure, etc.) In such embodiments, for example, the bar chart 61*c*2 may be kept in the same display mode regardless of whether the crosstalk cancellation has been executed.

Moreover, in the embodiment of tone generation control processing in FIG. 6 and FIG. 9, in S608, even when the CPU 11 determines that the target pad itself is not a striking pad (S608: No), the CPU 11 executes S609 and generates an envelope for crosstalk cancellation 72. In other embodiments, in S608, when the CPU 11 determines that the target pad itself is not a striking pad (S608: No), an envelope for crosstalk cancellation 72 is not generated. In other words, only when the CPU 11 determines that the target pad itself is a striking pad, the CPU 11 may generate an envelope for crosstalk cancellation 72. However, even when the CPU 11 determines in S608 that the target pad itself is not a striking pad, there is a possibility that the pad has actually been struck. Therefore, further embodiments generate an envelope for crosstalk cancellation 72 for a trigger signal that generated tone, irrespective of the determination of whether or not the pad is struck, like tone generation control processing of FIG. 6 and FIG. 9.

In embodiments described above, processing to cancel crosstalk based on striking at other pads during an ordinary performance is carried out. In other embodiments, crosstalk cancellation similar to embodiments described above is used in a device that can switch its screen and setting by striking at a pad, where the crosstalk cancellation may be used, in order to prevent the screen and the setting from changing by mistake due to crosstalk based on striking at other pads.

For example, in a device that can individually set the timbre to be allocated to each of individual pads on an edit screen provided for each of the pads, the device may be configured such that, by striking one of the pads that is to be edited, the corresponding edit screen is displayed. In this case, the edit screen of a pad that is not intended might be displayed due to crosstalk. To prevent such an unintended switching of the screen due to crosstalk, the switching of the screen may be controlled, similarly to the crosstalk cancellation executed during an ordinary performance, based on the determination of whether or not the crosstalk cancellation is to be executed for the detected trigger signal.

However, during an ordinary performance, the crosstalk cancellation may be executed with respect to striking on a part of plural pads, even though the plural pads are struck at the same time, which therefore does not generate a tone. Accordingly, the crosstalk cancellation setting value should be set to a proper value. In other words, the crosstalk cancellation setting value is improper if it is too large or too small.

In contrast, when the switching of the edit screen is controlled, the possibility of striking plural pads at the same time is low, such that setting the crosstalk cancellation setting value to a relatively large value would not likely cause a problem. Rather, by setting the crosstalk cancellation setting value relatively large, the screen can be reliably switched as intended by the user.

Therefore, when controlling the switching of the edit screen, a relatively large value that may be inappropriate as the crosstalk cancellation setting value for an ordinary performance that is set based on the amount of crosstalk (for example, from 40% to 100%), may be used as the crosstalk cancellation setting value (%) to calculate the crosstalk cancellation level. Then, whether or not the crosstalk cancellation is to be executed for the detected trigger signal may be determined based on the crosstalk cancellation level thus calculated. In other words, when it is determined that the crosstalk cancellation is not to be executed, the edit screen is switched to a screen for the pad corresponding to the detected trigger signal. When it is determined that the crosstalk cancellation is to be executed, the edit screen may be kept as is (in other words, not switched).

Moreover, in embodiments described above, the sound source device 1 (the tone generation control device 100) is connected with the pads 51-54 that are set up on the stand S. In other embodiments, the sound source device 1 (the tone generation control device 100) may be connected to or built into an electronic percussion instrument that includes plural pads on the same housing.

Moreover, in embodiments described above, the tone generation control device 100 is built into the sound source device 1 that has the sound source 16 and the DAC 17. In other embodiments, tone generation instructions based on the flow charts of FIGS. 6-8 may be output to an independent sound source. Also, in embodiments described above, the tone generation control device 100 is composed of the CPU 11, the ROM 12, the RAM 13 and the flash memory 14, and processing shown in the flow chart in FIG. 6 or the like is executed by the CPU 11. However, in accordance with other embodiments, the tone generation control device 100 may be composed with the sound source 21 included therein, and the DSP within the sound source 21 may execute processing described above as being executed by the CPU 11.

Moreover, in embodiments described above, the sound source device 1 includes the LCD 15 that is capable of displaying the crosstalk monitor screen 61. In other embodiments, the crosstalk monitor screen 61 may be displayed on a display device provided as an independent unit. Also, in embodiments described above, the FOCUS function and the SET function are called by the operators 16 (the ENTER button 16*d*, etc.) installed on the sound source device 1. In other embodiments, the FOCUS function and the SET function may be called by using an external controller, etc. In still other embodiments, the LCD 15 may be made of a touch panel, and is configured to call the FOCUS function and the SET function when the FOCUS button 61*d* and the SET button 61*e* are touched on the touch panel. In yet further embodiments, a FOCUS button that can call the FOCUS function and a SET button that can call the SET function may be installed in the operators 16, and configured such that the FOCUS function and the SET function can be directly called when these FOCUS button and SET button are operated.

In embodiments described above, the CPU 11 is an example of a detection device that detects a trigger signal. The flash memory 14 (the setting value area 14*a*) is an example of a setting value storage device. The processing of S607 is an example of a judgment (or determining) device. The processing of S607 is an example of a tone generation instruction controlling device. The processing of S611 is an example of a value calculation device. The processing of S808 executed based on the memory content of the display information area 13*a* is an example of a display device. The processing of S809 is an example of a striking surface selection device. The processing of S810 is an example of a setting value changing device. The processing of S901 is an example of a setting value changing device.

The invention claimed is:

1. A tone generation control device, comprising:

a detection device that detects vibration generated in each striking surface of a plurality of striking surfaces;

a setting value storage device that stores, for each one of the striking surfaces, a setting value to be used to determine whether vibration generated at the one striking surface is vibration due to crosstalk that is generated based on vibration of a comparison striking surface from the plurality of striking surfaces other than the one striking surface, for which a tone generation instruction is not to be output;

a determining device that determines, based on the setting value stored in the setting value storage device, whether or not the vibration generated at a target striking surface is vibration due to crosstalk for which the tone generation instruction is not to be output, the target striking surface being a striking surface at which vibration is detected by the detection device; and a tone generation instruction controlling device that outputs a tone generation instruction when the determining device determines that the vibration generated at the target striking surface is not due to crosstalk for which the tone generation instruction is not to be output, wherein the tone generation instruction controlling device does not output a tone generation instruction when the determining device determines that the vibration generated at the target striking surface is vibration due to crosstalk for which the tone generation instruction is not to be output;

the tone generation control device comprising:

a value calculation device that calculates a value indicative of the degree of crosstalk the target striking surface received from the comparison striking surface, when vibration at the target striking surfaces is detected by the detection device; and a display control device that displays, on a display device, the setting value stored in the setting value storage device for each of the striking surfaces, and the value indicative of the degree of crosstalk calculated by the value calculation device, whether or not a tone generation instruction is output by the tone generation instruction controlling device.

2. A tone generation control device according to claim 1, wherein the display control device displays on the display device indicia that is visually distinguishable as to whether or not a tone generation instruction is output by the tone generation instruction controlling device.

3. A tone generation control device according to claim 2, further comprising:

a striking surface selection device that, each time a first operation is input, sequentially switches and selects from among the striking surfaces for which a value indicative of the degree of crosstalk is displayed on the display device, one of the striking surfaces for which a tone generation instruction is output by the tone generation instruction controlling device, as a selected striking surface; and a setting value changing device that changes the setting value stored in the setting value storage device for the selected striking surface, when a second operation is input, based on the value calculated by the value calculation device for the selected striking surface.

4. A tone generation control device according to claim 2, further comprising a setting value changing device that, when the value indicative of the degree of crosstalk is calculated by the value calculation device, changes the setting value stored in the setting value storage device for a striking surface, based on the value calculated.

5. A tone generation control device according to claim 2, wherein the value calculation device calculates a value indicative of the degree of crosstalk the target striking surface received from the comparison striking surface, based on the level of vibration generated at the target striking surface and the level of vibration of the comparison striking surface which changes with time.

6. A tone generation control device according to claim 2, wherein the determining device determines whether or not vibration generated at the target striking surface is vibration caused by crosstalk for which the tone generation instruction is not to be output, based on the level of vibration generated at the target striking surface, the level of vibration of the comparison striking surface which changes with time, and the setting value stored in the setting value storage device.

7. A tone generation control device according to claim 1, further comprising:

a striking surface selection device that, each time a first operation is input, sequentially switches and selects from among the striking surfaces for which a value indicative of the degree of crosstalk is displayed on the display device, one of the striking surfaces for which a tone generation instruction is output by the tone generation instruction controlling device, as a selected striking surface; and a setting value changing device that changes the setting value stored in the setting value storage device for the selected striking surface, when a second operation is input, based on the value calculated by the value calculation device for the selected striking surface.

8. A tone generation control device according to claim 7, wherein the value calculation device calculates a value indicative of the degree of crosstalk the target striking surface received from the comparison striking surface, based on the level of vibration generated at the target striking surface and the level of vibration of the comparison striking surface which changes with time.

9. A tone generation control device according to claim 7, wherein the determining device determines whether or not vibration generated at the target striking surface is vibration caused by crosstalk for which the tone generation instruction is not to be output, based on the level of vibration generated at the target striking surface, the level of vibration of the comparison striking surface which changes with time, and the setting value stored in the setting value storage device.

10. A tone generation control device according to claim 1, further comprising a setting value changing device that, when the value indicative of the degree of crosstalk is calculated by the value calculation device, changes the setting value stored in the setting value storage device for a striking surface, based on the value calculated.

11. A tone generation control device according to claim 10, wherein the value calculation device calculates a value indicative of the degree of crosstalk the target striking surface received from the comparison striking surface, based on the level of vibration generated at the target striking surface and the level of vibration of the comparison striking surface which changes with time.

12. A tone generation control device according to claim 10, wherein the determining device determines whether or not vibration generated at the target striking surface is vibration caused by crosstalk for which the tone generation instruction is not to be output, based on the level of vibration generated at the target striking surface, the level of vibration of the comparison striking surface which changes with time, and the setting value stored in the setting value storage device.

13. A tone generation control device according to claim 1, wherein the value calculation device calculates a value indicative of the degree of crosstalk the target striking surface received from the comparison striking surface, based on the level of vibration generated at the target striking surface and the level of vibration of the comparison striking surface which changes with time.

14. A tone generation control device according to claim 13, wherein the determining device determines whether or not vibration generated at the target striking surface is vibration caused by crosstalk for which the tone generation instruction is not to be output, based on the level of vibration generated at the target striking surface, the level of vibration of the comparison striking surface which changes with time, and the setting value stored in the setting value storage device.

15. A tone generation control device according to claim 1, wherein the determining device determines whether or not vibration generated at the target striking surface is vibration caused by crosstalk for which the tone generation instruction is not to be output, based on the level of vibration generated at the target striking surface, the level of vibration of the comparison striking surface which changes with time, and the setting value stored in the setting value storage device.

16. A tone generation control method, including:

detecting vibration generated in each striking surface of a plurality of striking surfaces;

storing, for each one of the striking surfaces, a setting value in a setting value storage device, the setting value to be used to determine whether vibration generated at the one striking surface is vibration due to crosstalk that is generated based on vibration of a comparison striking surface from the plurality of striking surfaces other than the one striking surface, for which a tone generation instruction is not to be output;

determining, based on the setting value stored in the setting value storage device, whether or not the vibration generated at a target striking surface is vibration due to crosstalk for which the tone generation instruction is not to be output, the target striking surface being a striking surface at which vibration is detected; and outputting a tone generation instruction from a tone generation instruction controlling device when the determining determines that the vibration generated at the target striking surface is not due to crosstalk for which the tone generation instruction is not to be output, wherein the tone generation instruction controlling device does not output a tone generation instruction when the vibration generated at the target striking surface is determined to be vibration due to crosstalk for which the tone generation instruction is not to be output;

wherein outputting the tone generation instruction from the tone generation instruction controlling device comprises:

calculating a value indicative of a degree of crosstalk the target striking surface received from a comparison striking surface, when vibration at the target striking surface is detected; and displaying on a display device, the setting value stored in the setting value storage device for each of the striking surfaces, and the calculated value indicative of the degree of crosstalk calculated, whether or not a tone generation instruction is output by the tone generation instruction controlling device.

17. A method according to claim 16, further comprising displaying on the display device indicia that is visually distinguishable as to whether or not a tone generation instruction is output by the tone generation instruction controlling device.

18. A method according to claim 16, comprising:

sequentially switching and selecting, each time a first operation is input, from among the striking surfaces for which a value indicative of the degree of crosstalk is displayed on the display device, one of the striking surfaces for which a tone generation instruction is output by the tone generation instruction controlling device, as a selected striking surface; and changing the setting value stored in the setting value storage device for the selected striking surface, when a second operation is input, based on the value calculated for the selected striking surface.

19. A method according to claim 16, further comprising changing the setting value stored in the setting value storage device for a striking surface, based on the calculated value, when the value indicative of the degree of crosstalk is calculated.

20. A method according to claim 16, wherein calculating a value indicative of the degree of crosstalk the target striking surface received from the comparison striking surface comprises calculating the value based on the level of vibration generated at the target striking surface and the level of vibration of the comparison striking surface which changes with time.

* * * * *